US007405189B2

(12) United States Patent
Lee

(10) Patent No.: US 7,405,189 B2
(45) Date of Patent: Jul. 29, 2008

(54) SURFACE TREATMENT COMPOSITION AND METHOD FOR REMOVING SI COMPONENT AND REDUCED METAL SALT PRODUCED ON THE ALUMINUM DIE CAST MATERIAL IN ETCHING PROCESS

(75) Inventor: Eul-Kyu Lee, Kyounggi-do (KR)

(73) Assignee: Cheon Young Chemical Co., Ltd. (KR)

( * ) Notice: Subject to any disclaimer, the term of this patent is extended or adjusted under 35 U.S.C. 154(b) by 194 days.

(21) Appl. No.: 10/484,868

(22) PCT Filed: Jul. 25, 2002

(86) PCT No.: PCT/KR02/01398

§ 371 (c)(1),
(2), (4) Date: Jan. 23, 2004

(87) PCT Pub. No.: WO03/010271

PCT Pub. Date: Feb. 6, 2003

(65) Prior Publication Data

US 2004/0242445 A1 Dec. 2, 2004

(30) Foreign Application Priority Data

Jul. 25, 2001 (KR) ..... 2001-44780
Feb. 7, 2002 (KR) ..... 2002-7084

(51) Int. Cl.
*C11D 7/18* (2006.01)
*C11D 7/04* (2006.01)
*C11D 7/26* (2006.01)
*C23G 1/12* (2006.01)

(52) U.S. Cl. ..... 510/254; 510/257; 510/375; 510/405; 510/506; 134/2; 134/42

(58) Field of Classification Search ..... 510/175, 510/254, 257, 375, 405, 506; 134/2, 42
See application file for complete search history.

(56) References Cited

U.S. PATENT DOCUMENTS 3,841,905 A * 10/1974 Dixon, III ..... 216/20
3,979,241 A 9/1976 Maeda et al.
3,990,982 A * 11/1976 Dixon ..... 252/79.3
RE29,181 E * 4/1977 Dixon, III ..... 216/13
4,410,396 A * 10/1983 Somers et al. ..... 216/109
4,510,018 A * 4/1985 McGowan ..... 216/107
5,990,060 A 11/1999 Ohmi et al.
6,323,169 B1 * 11/2001 Abe et al. ..... 510/176
6,514,352 B2 * 2/2003 Gotoh et al. ..... 134/3

FOREIGN PATENT DOCUMENTS

JP 55-109498 A 8/1980
JP 58107487 * 6/1983
JP 07149931 * 6/1995
JP 08-250461 A 9/1996
JP 10-298589 A 11/1998
JP 2001-144064 A 5/2001
WO WO 99/03140 A1 1/1999

* cited by examiner

*Primary Examiner*—Lorna M Douyon
(74) *Attorney, Agent, or Firm*—The Webb Law Firm, P.C.

(57) ABSTRACT

A surface treatment composition and method for removing Si and reduced metal salt produced during etching of an aluminum die cast material ("ALDC material") without generation of nitrogen oxide (NOx) or hydrogen fluoride (HF). In surface treatment of an ALDC material containing Si, Fe, Cu, Mn, Mg, Zn and Ni, the surface treatment composition for removing Si and reduced metal salt from the surface of the ALDC material after etching comprises hydrogen peroxide 300 to 950 g/l, fluorine ion-containing inorganic salt 1 to 300 g/l and balance water. The surface treatment method for removing Si and reduced metal salt from the surface of an ALDC material after etching comprises the step of dipping the ALDC material into the above described surface treatment composition. The aforementioned surface treatment composition effectively removes the Si and reduces metal salt impurities from the surface of the ALDC material without any problems such as NOx or HF gas which is harmful to the human and waste water treatment. Further, residue oil is also removed from the ALDC material.

18 Claims, 3 Drawing Sheets

SURFACE TREATMENT COMPOSITION AND METHOD FOR REMOVING SI COMPONENT AND REDUCED METAL SALT PRODUCED ON THE ALUMINUM DIE CAST MATERIAL IN ETCHING PROCESS

BACKGROUND OF THE INVENTION

1. Field of the Invention

The present invention generally relates to a composition and method in use for surface treatment of parts made of Al Die Casting material (hereinafter will be referred to as "ALDC material"). In particular, the invention pertains to a surface treatment composition and method without generation of nitrogen oxide (NOx) or hydrogen fluoride (HF) for removing Si and reduced metal salt produced during etching of the ALDC material.

2. Description of the Prior Art

An ALDC material generally contains Al and other ingredients such as Si, Fe, Cu, Mn, Mg, Zn and Ni. Such ALDC material requires surface treatment such as plating, painting and anodizing in order to improve corrosion resistance, and appearance. In general, the ALDC material undergoes a surface treatment including plating, process which is carried out in the order of degreasing, etching, desmutting, zincating and plating, and painting process which is carried out in the order of degreasing, etching, desmutting, drying and painting.

In the above processes, etching is generally carried out in a NaOH aqueous solution. Etching for the ALDC plating is performed at a temperature ranging from a room temperature to 50° C. in an about 5 to 20% NaOH aqueous solution in order to remove any oxide layer and/or oil from the surface of the ALDC, and closely related to formation of surface roughness for plating.

ALDC (1)→ALDC (2)+Al dissolution {$3NaOH+Al \rightarrow Al(OH)_3+H_2\uparrow$} (NaOH aqueous solution, etching)

In the above process, components such as Si, Fe, Cu, In, Mg, Zn and Ni contained in ALDC (1) appear on the surface of the ALDC (2) as Al, that is the main component of the ALDC, are dissolved during etching, in which those components such as Si, Cu, Fe, Mn and Ni are not dissolved into the NaOH aqueous solution and accordingly remain in the surface of ALDC (2).

Tables 1A and 1B and FIGS. 1A and 1B respectively represent results of EDAX analysis about the components in the surface of ALDC (2) which has been dipped for 10 minutes in a 10% NaOH aqueous solution, in which the ALDC materials are analyzed based upon ALDC-7 and ALDC-8.

TABLE 1A

Analysis of Surface Component in ALDC-7 (2)
Result of Quantitative Analysis

| Component | Weight % | Atomic % |
|---|---|---|
| O | 14.91 | 26.00 |
| Cu | 7.96 | 3.49 |
| Na | 1.78 | 2.16 |
| Mg | 0.00 | 0.00 |
| Al | 6.63 | 6.85 |
| Si | 54.99 | 54.63 |
| Fe | 13.75 | 6.87 |

TABLE 1B

Analysis of Surface Component in ALDC-8 (2)
Result of Quantitative Analysis

| Component | Weight % | Atomic % |
|---|---|---|
| O | 17.05 | 30.11 |
| Cu | 4.83 | 2.15 |
| Na | 2.51 | 3.09 |
| Mg | 1.77 | 2.06 |
| Al | 20.85 | 21.83 |
| Si | 27.91 | 98.08 |
| Fe | 25.07 | 12.68 |

As can be seen in Tables 1A and 1B, those components such as Si, Fe and Cu are the most prominent components after etching of the ALDC material. Those components should be necessarily removed from the surface of the materials since they influence coherence and uniformity during final plating, painting and anodizing.

In an aqueous solution, generally each of the metal components is reduced and deposits to the surface of an aluminum material such as Al or Al alloy (Al 2024, Al 5083) so as to form reduced metal salts during oxidation reaction, in which the etched Al or Al alloy material is mainly dipped into a $HNO_3$ aqueous solution according to a conventional method for removing the reduced metal salts.

When the ALDC material is dipped into the $HNO_3$ aqueous solution, the metal components such as Cu, Fe and Ni are dissolved and ionized in the $HNO_3$ aqueous solution as follows:

$$Cu \rightarrow Cu^{2+}+2e-;$$

$$Fe \rightarrow Fe^{2+}+2e-; \text{ and}$$

$$Ni \rightarrow Ni^{2+}+2e-.$$

On the other hand, a mixed acid solution of $HNO_3$ and HF has been conventionally used to remove the metal and Si components formed on the material during NaOH etching of the ALDC material. This has a reaction mechanism as follows:

(1) Reaction mechanism of metal components except for Si contained in ALDC with $HNO_3$:

Me (Fe, Cu. Mn, Mg, Zn, Ni)+$HNO_3+H_2O \rightarrow MeO+HNO_2+H_2O \rightarrow MeO+H++NO_2\uparrow+H_2O$ (First Reaction)→$MeO+2HNO_3+H_2O \rightarrow Me(NO_3)_2+H_2O$ (Second Reaction)

In the first reaction, $HNO_2$ is gasified into H+ and $NO_2$ in the aqueous solution and thus emits toxic NOx gas, which is harmful to humans and the environment.

(2) Reaction mechanism of $SiO_2$ with HF:

$$SiO_2+4HF \rightarrow SiF_4+2H_2O+H_2\uparrow \text{ (First Reaction)}$$

$$2HF+SiF_4 \rightarrow H_2SiF_6 \text{ (Second Reaction)}$$

In the first reaction, HF gas is emitted owing to generation of $H_2$ gas.

Although a chemical treatment method of the ALDC material using $HNO_3$ and HF has been performed for a long time, this method produces a large amount of NOx and HF gases and thus fatally acts to human bodies and facilities.

FIG.2 illustrates HF and NOx gases which are produced from the ALDC material treatment with a mixed acid of $HNO_3$ and HF, and Table 2 represents measured amounts of the HF and NOx gases. As can be seen in Table 2, mixed acid of $HNO_3$ and HF emits the NOx and HF gases by a large amount thereby representing a severe obstacle against substitution of the ALDC for Al.

TABLE 2

Quantity of HF and NOx Emission during ALDC material Treatment in Mixed Acid of $HNO_3$ and HF

| | NOx | HF |
|---|---|---|
| Quantity of Gas Generation (ppm) | 10,722.22 | 3,840.53 |

Also as known in the conventional art, methods have been used to clean foreign materials from semiconductor board by using compositions each composed of an inorganic substance containing hydrogen peroxide and fluorine ion as disclosed in Japanese Patent Laid-Open Nos. H08-250461 and H10-298589. However, the compositions show poor oxidizing power owing to very small value of peroxide content. The above substrate-cleaning agents may partially remove Si from the surface of the ALDC material during etching but fails to simultaneously remove the reduced metal components such as Fe, Cu, Mn, Mg, Zn and Ni from the same.

SUMMARY OF THE INVENTION

The present invention has been made to solve the above problems and it is therefore an object of the present invention to provide a surface treatment composition capable of removing Si and reduced metal components such as Fe, Cu, Mn, Mg, Zn and Ni from the surface of an ALDC material without producing toxic gases such as NOx and HF during etching in a chemical surface treatment process of the ALDC material, and additionally dissolving residue oil from the material surface.

It is another object of the invention to provide a surface treatment method using the above surface treatment composition capable of removing Si and reduced metal components such as Fe, Cu, Mn, Mg, Zn and Ni from the surface of an ALDC material without producing toxic gases such as NOx and HF during etching in a chemical surface treatment process of the ALDC material and additionally dissolving residue oil from the material surface.

According to an aspect of the invention to obtain the above objects, it is provided a surface treatment composition of ALDC material for removing Si and reduced metal salt from the surface of an ALDC material after etching, wherein the surface treatment composition comprises hydrogen peroxide 300 to 950 g/l and fluorine ion-containing inorganic salt 1 to 300 g/l.

According to another aspect of the invention to obtain the above objects, it is provided a surface treatment composition of ALDC material for removing Si and reduced metal salt from the surface of an ALDC material after etching, wherein the surface treatment composition comprises hydrogen peroxide 300 to 950 g/l, fluorine ion-containing inorganic salt 1 to 300 g/l and balance water.

According to a further aspect of the invention to obtain the above objects, a surface treatment method of ALDC material is provided for removing Si and reduced metal salt from the surface of an ALDC material after etching, the method comprising the step of dipping the ALDC material into the surface treatment composition according to the invention.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1A:
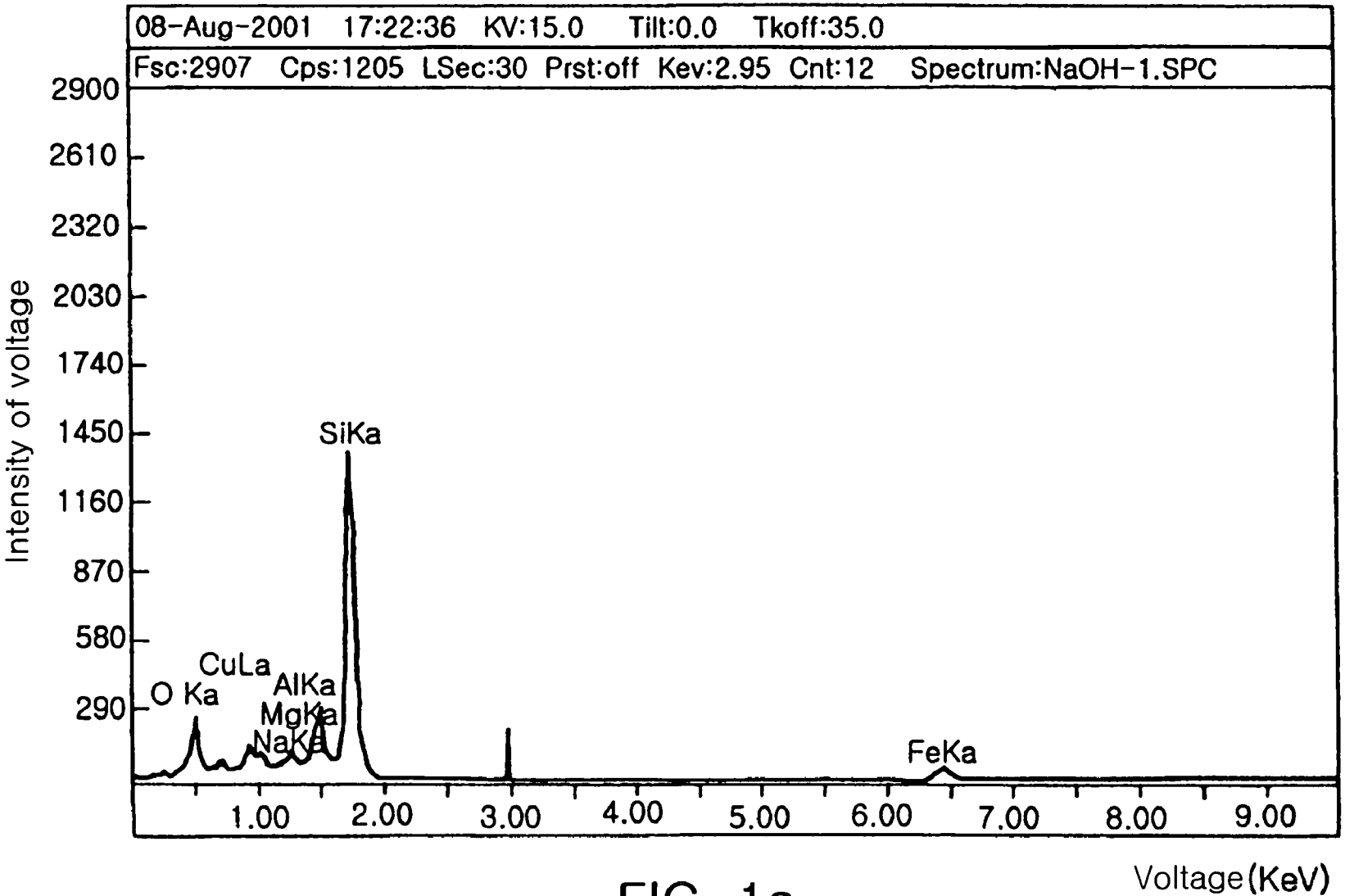
FIG. 1A is a graph illustrating results of component analysis on the surface of ALDC-7 dipped in a NaOH 10% aqueous solution for 10 minutes.
Figure 1B:
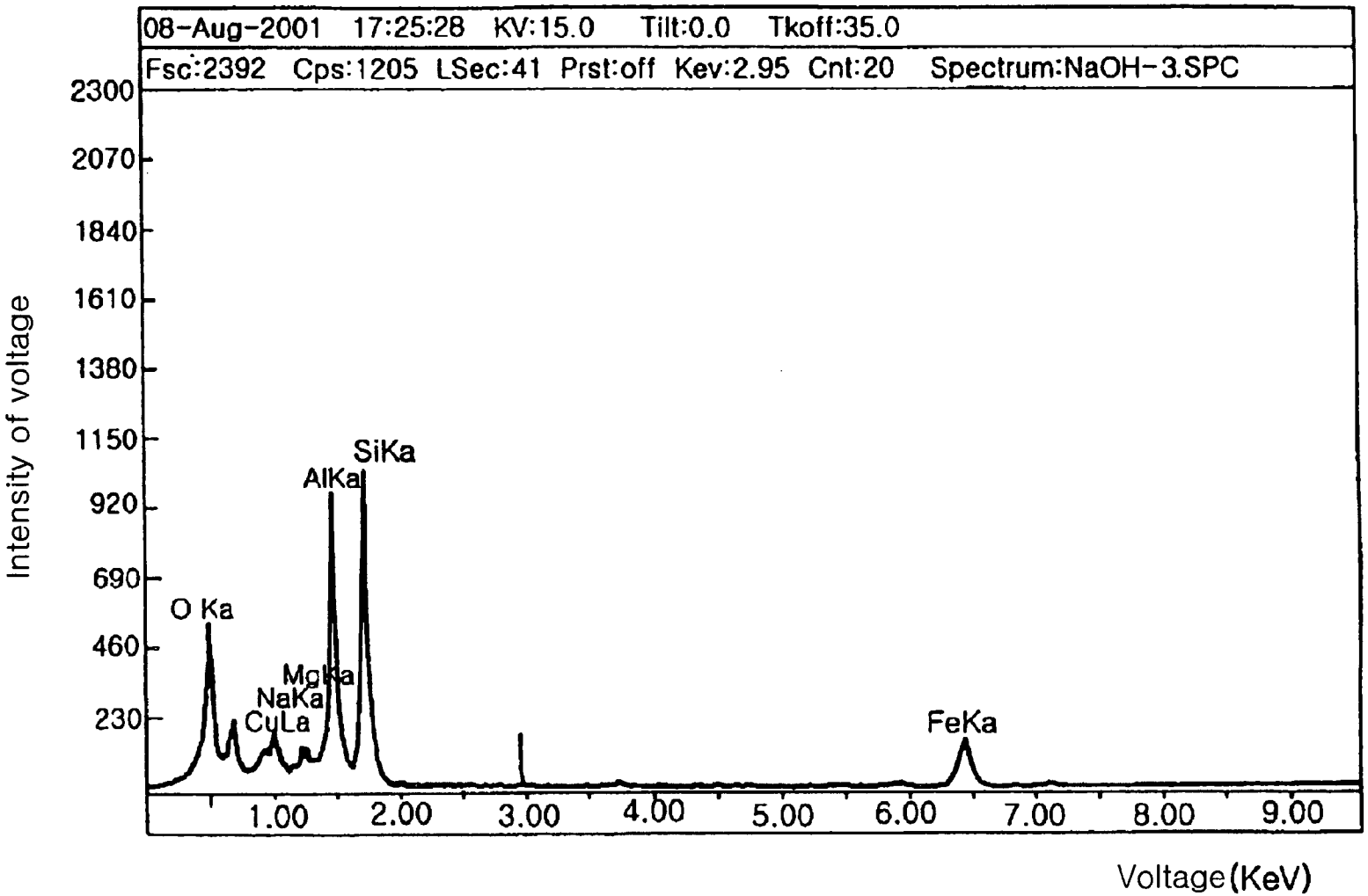
FIG. 1B is a graph illustrating results of component analysis on the surface of ALDC-8 dipped in a NaOH 10% aqueous solution for 10 minutes.
Figure 2:
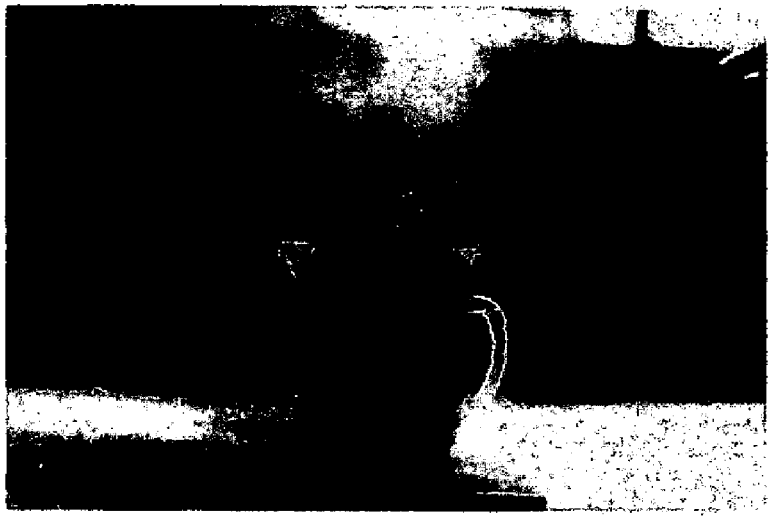
FIG. 2 is a picture of an ALDC material emitting HF and NOx gases when treated with a mixed acid of $HNO_3$ and HF in the prior art.

An ALDC material was etched in a NaOH aqueous solution and then dipped into a surface treatment composition of the invention comprising inorganic salt which contains hydrogen peroxide and fluorine ion (hereinafter will be referred to as "fluorine ion-containing inorganic salt"). Si component on the surface of the etched ALDC material and metal salt impurities such as Fe, Cu, Mn, Mg, Zn and Ni provided from the ALDC material itself or reduced during etching are rapidly dissolved to form precipitations in the surface treatment composition. In addition residual oil is dissolved and removed from the surface of the material.

The surface treatment composition comprises inorganic salt which contains hydrogen peroxide and fluorine ion. Also, the surface treatment composition, may comprise hydrogen peroxide, fluorine ion-containing inorganic salt and residue water. Furthermore, the surface treatment composition comprising hydrogen peroxide, fluorine ion-containing inorganic salt and residue water may further comprise water-soluble ether.

Water-soluble ether not only reacts as solvent but also functions as inhibitor for protecting the ALDC material and reduces surface tension in the system. Using water-soluble ether prolongs the lifetime of the surface treatment composition. Hydrogen peroxide ($H_2O_2$) reacts as not only oxidizer but also solvent for dissolving fluorine ion-containing inorganic salt. Hydrogen peroxide is contained for 300 to 950 g/l and preferably 300 to 700 g/l.

Where hydrogen peroxide is less than 300 g/l (about 30 wt %), the oxidizing power of the surface treatment composition is degraded so that metal ion and the Si component adhering strongly to the material surface are removed only in part rather than completely removed. Further, hydrogen peroxide is used for up to 950 g/l (about 95 wt %) since the surface treatment composition essentially comprises fluorine ion-containing inorganic salt.

Fluorine ion-containing inorganic salt functions to dissolve and remove the Si component from the surface of the etched material, and available examples of fluorine ion-containing inorganic salt thereof may include acidic ammonium fluoride ($NH_4HF_2$), ammonium fluoride ($NH_4F$) and mixture thereof. Fluorine ion-containing inorganic salt is contained for about 1 to 300 g/l and preferably 50 to 300 g/l. Fluorides would not produce gas even though they have a high concentration. Si is insufficiently dissolved where the content of fluorine ion-containing inorganic salt is under 1 g/l, and fluorine ion-containing inorganic salt can be dissolved into the surface treatment composition up to 300 g/l at a room temperature.

Available examples of water-soluble ether may include ethylene glycol monobutyl ether, dipropylene glycol monoethyl ether and mixture thereof. Water-soluble ether not only reduces surface tension of the surface treatment composition but also subsidiarily serves to dissolve residual oil from the material surface and functions as inhibitor for preventing re-adhesion of the dissolved metal ion and Si component to the material surface. Water-soluble ether is used in a range from 0.5 to 100 g/l and preferably 1 to 30 g/l.

Ether insufficiently reacts to reduce surface tension where its content is under 0.5 g/l, and on the other hand, would similarly react even though its content exceeds 100 g/l.

Further, commonly available water can be used as solvent and balance of the surface treatment composition comprising hydrogen peroxide and fluorine ion-containing inorganic salt or the composition comprising hydrogen peroxide, fluorine ion-containing inorganic salt and water-soluble ether.

Water ($H_2O$) subsidiarily dissolves hydrogen peroxide, fluorine ion-containing inorganic salt and -ether solvent to stabilize the system. Water is used by a commonly used quantity for about 5 to 600 g/l and preferably 50 to 300 g/l.

The etched ALDC material is dipped into the surface treatment composition as set forth above so that the Si and metal salt components are effectively dissolved and thus removed from the material surface without generation of nitrogen oxide (NOx) or hydrogen fluoride (HF) gases.

The dipping time of the ALDC material in the surface treatment composition has not been limited especially, but may be generally set for about 3 minutes without any restrictive purposes. As the ALDC material is dipped into the surface treatment solution of the invention, the Si and metal salt components are dissolved and removed from the material surface according to the following mechanism:

The metal components contained in the ALDC except for Si react with $H_2O_2$in a weak acidic solution having H+ ion:

$$\text{Me (Fe,Cu,Ni,Mn,Mg,Zn)}+nH^+ + 2H_2O_2 \rightarrow Me^{2+} + 2H_2O + O_2 \rightarrow MeOx + 2H_2 \rightarrow \quad \text{Equation 1.}$$

As a specific example, $$4Cu + \delta H^+ + 2H_2O_2 + 2H^+ \rightarrow 4Cu^{2+} + 2H_2O + O_2 + 2H^+ \rightarrow 4CuO + 2H_2 \rightarrow \quad \text{Equation 2, and}$$

$$2Fe + 4H^+ + 2H_2O_2 + 2H^+ \rightarrow 2Fe^{2+} + 2H_2O + O_2 + 2H^+ \rightarrow Fe_2O4^{2-} + 2H_2 \rightarrow \quad \text{Equation 3.}$$

In the above reactions, those components such as Zn, Mg and Fe having high ionization tendency are dissolved in a low concentration $H_2O_2$ (at 10% of the total volume or less) and a weal acidic solution and thus removed from a material. On the other hand, those metal components such as Cu, Mn and Ni having low ionization tendency are not dissolved in the low concentration $H_2O_2$ and weak acidic solutions.

Accordingly, the invention uses $H_2O_2$ preferably with high concentration of about 30 wt % or more in order to remove all of the metal impurities from the metal surface at one time during etching. In order to shorten the treatment time, it is preferred to maintain the concentration of $H_2O_2$ in the composition for at least 70 wt %. Since the surface treatment composition of the invention contains $H_2O_2$ for a high concentration of at least 30 wt %, it provides oxidizing power as high as a mixed acid of $HNO_3$ and HF which has been used as a conventional surface treatment composition so that the metal impurities are effectively removed from the surface of the etched ALDC material.

As can be seen in Equations 2 and 3, the inventive composition produces non-toxic $H_2$ and $O_2$ gases only. So, NOx or HF gas is not produced.

In the meantime, the Si component reacts according to the following Equations 4 and 5 and then is removed from the material:

$$Si + H_2O_2 \rightarrow Si + 2H^+ + O^{2-} \rightarrow SiO_2 \quad \text{Equation 4, and}$$

$$NH_4HF_2 + SiO_2 + H_2O_2 + H_2O \rightarrow (NH_4)_2SiF_6 + 2H_2O + O_2 \quad \text{Equation 5.}$$

In the above reactions, fluorine ion-containing inorganic salt provides functions of supplying hydrogen ion into the entire solution to reduce pH of the solution down to 4 or less and transforming the Si component into the form of silicon fluoride which is readily dissolved. High oxidizing power of the $H_2O_2$ assists the Si component to be rapidly dissolved and separated from the surface of the ALDC material. The above Equations 4 and 5 hardly produce gases.

The surface treatment composition of the invention composed as above effectively dissolves and removes the Si and reduced metal salt impurities from the surface of an etched ALDC material without producing any NOx or HF gas when the etched ALDC material is dipped into the composition of the invention.

Also, the Si and reduced metal salt impurities are effectively removed from the surface of the etched ALDC so as to enhance coherence and uniformity in final plating, painting and anodizing. Furthermore, residue oil is, dissolved and removed from the ALDC material.

EXAMPLES

The following detailed description will present preferred embodiments of the invention, in which the embodiments disclose the invention for the illustrative purposes only.

Example 1

A surface treatment composition (A) was prepared by mixing $H_2O_2$ 500 g/l, ammonium bifluoride 200 g/l and $H_2O$ 300 g/l.

An ALDC test piece etched in a NaOH 20% aqueous solution was dipped into the composition (A) for 1 minute to remove the black Si component and the reduced metal salts (smut) from the surface of the test piece.

Figure 3:
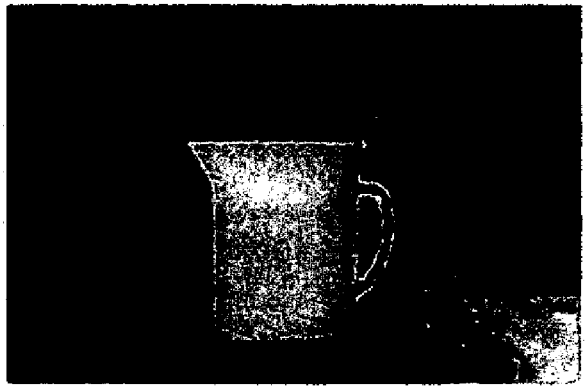
FIG. 3 is a picture of an ALDC material emitting no HF or NOx gas when treated with a surface treatment composition of the invention.

As can be seen from FIG. 3, this process did not produce any NOx or HF gas which is produced in treatment with a mixed solution of $HNO_3$ and HF.

The treated test piece was cleaned with water and then dried so as to expose bright color of Al from the material surface since the black Si component was completely removed. When a paint made of urethane resin was applied on the test piece, the ALDC material was highly coherent with the paint.

This shows that the Si component and reduced metal salts were completely removed from the surface of the ALDC material when the ALDC material was treated with the composition according to the embodiment 1.

Example 2

$H_2O_2$ 800 g/l and ammonium bifluoride 200 g/l were mixed to prepare a surface treatment composition (B).

An ALDC test piece etched in a NaOH 20% aqueous solution was dipped into the surface treatment composition (B) for two minutes to remove the black Si component and reduced metal salts from the surface of the test piece. The treated test piece was cleaned with water and then dried so as to expose the bright color of Al from the material surface since the black Si component was completely removed. Subsequently, electroless nickel-plating was performed on this test piece.

In the electroless Ni-plating, the test piece was cleaned with water, dipped into a solution consisting of ZnO 30g/l and NaOH 240g/l for zinc-substitution at 25° C. for 3 minutes, and then dipped into an electroless Ni-plating solution consisting of nickel sulphate 50g/l, sodium hypophosphite 45g/l, lactic acid 10g/l and succinic acid 7g/l and balance water at 95° C.

As a result, Ni-plating was uniformly formed across the material surface. This shows that the Si component and reduced metal salts were completely removed from the surface of the ALDC material when the ALDC material was treated with the surface treatment composition according to this embodiment.

Example 3

A surface treatment composition (C) was prepared by mixing $H_2O_2$ 400 g/l, ammonium bifluoride 150 g/l, ethylene glycol monobutyl ether 30 g/l and $H_2O$ 300 g/l.

An ALDC test piece etched in a NaOH aqueous solution was dipped into the surface treatment composition (C) for two minutes to remove the black Si component and the reduced metal salts from the surface of the test piece.

The treated test piece was cleaned with water and then dried so as to expose the bright color of Al from the material surface since the black Si component was completely removed.

The test piece was cleaned with water, and then anodized in $H_2SO_4$ of 300 g/l under conditions of 20° C., 10A and $5V/dm^2$.

The anodizing was performed for 30 minutes to form a uniform oxide layer of $Al_2O_3$ across the material surface. Tis result shows that the Si component and reduced metal salts were completely removed from the surface of the ALDC material when the ALDC material was treated with the surface treatment composition according to this embodiment.

In removing the Si and reduced metal salt impurities formed on the surface of the ALDC material during etching, the surface treatment composition of the invention effectively removes the Si and reduced metal salt impurities from the ALDC material without any problems such as NOx or HF gas which is harmful to humans and waste water treatment. Further, residue oil is also removed from the ALDC material.

The invention enables the ALDC material to be readily plated or painted like Al alloy materials thereby promoting productivity. The Si and reductive metal salt impurities are effectively removed from the surface of the etched ALDC material so as to enhance coherence and uniformity in final plating, painting and anodizing.

In particular, the invention is expected to promote preservation of the global environment from the NOx and HF gases.

The invention claimed is:

1. A surface treatment composition for removing Si and reduced metal salt from the surface of an aluminum die casting (ALDC) material after etching without emitting nitrogen oxide (NOx) and/or hydrogen fluoride (HF) gas, the surface treatment composition comprising an effective amount of hydrogen peroxide 300 to 950 g/l, fluorine ion-containing inorganic salt 150 to 300 g/l and water-soluble ether 1 to 30 g/l to remove Si and reduced metal salt from surface treatment of an ALDC material.

2. The surface treatment composition according to claim 1, wherein said water-soluble ether is selected from the group consisting of ethylene glycol monobutyl ether, dipropylene glycol monoethyl ether and mixture thereof.

3. The surface treatment composition according to claim 1, wherein said hydrogen peroxide is 300 to 700 g/l.

4. The surface treatment composition according to claim 1, wherein said fluorine ion-containing inorganic salt is 200 to 300 g/l.

5. The surface treatment composition according to claim 1, wherein said fluorine ion-containing inorganic salt is selected from the group consisting of ammonium bifluoride ($NH_4HF_2$), ammonium fluoride ($NH_4F$) and mixture thereof.

6. A surface treatment composition according to claim 1, wherein the composition dissolves residual oil from the surface of an aluminum die casting (ALDC) material after etching.

7. A surface treatment composition according to claim 1, wherein the composition prevents re-adhesion of the reduced metal salt and Si component to the material surface.

8. A surface treatment composition according to claim 1, wherein the reduced metal salt to be removed from the surface of an aluminum die casting (ALDC) material comprises iron, copper, manganese, magnesium, zinc and nickel.

9. A surface treatment method of ALDC material for removing Si and reduced metal salt from the surface of an ALDC material after etching, the method comprising the step of dipping the ALDC material into a surface treatment composition according to claim 1.

10. A surface treatment composition for removing Si and reduced metal salt from the surface of an aluminum die casting (ALDC) material after etching without emitting NOx and/or HF gas the surface treatment composition comprising: an effective amount of hydrogen peroxide 300 to 950 g/l, fluorine ion-containing inorganic salt 150 to 300 g/l, water-soluble ether 1 to 30 g/l and balance water to remove Si and reduced metal salt from surface treatment of an ALDC material.

11. The surface treatment composition according to claim 10, wherein said water-soluble ether is selected from the group consisting of ethylene glycol monobutyl ether, dipropylene glycol monoethyl ether and mixture thereof.

12. The surface treatment composition according to claim 10, wherein said hydrogen peroxide is 300 to 700 g/l.

13. The surface treatment composition according to claim 10, wherein said fluorine ion-containing inorganic salt is 200 to 300g/l.

14. The surface treatment composition according to claim 13, wherein said fluorine ion-containing inorganic salt is selected from group consisting of ammonium bifluoride ($NH_4HF_2$), ammonium fluoride ($NH_4F$) and mixture thereof.

15. A surface treatment composition according to claim 10, wherein the composition dissolves residual oil from the surface of an aluminum die casting (ALDC) material after etching.

16. A surface treatment composition according to claim 10, wherein the composition prevents re-adhesion of the reduced metal salt and Si component to the material surface.

17. A surface treatment composition according to claim 10, wherein the reduced metal salt to be removed from the surface of an aluminum die casting (ALDC) material comprises iron, copper, manganese, magnesium, zinc and nickel.

18. A surface treatment method of ALDC material for removing Si and reduced metal salt from the surface of an ALDC material after etching, the method comprising the step of dipping the ALDC material into; a surface treatment composition according to claim 2.

* * * * *

UNITED STATES PATENT AND TRADEMARK OFFICE

CERTIFICATE OF CORRECTION

PATENT NO. : 7,405,189 B2
APPLICATION NO. : 10/484868
DATED : July 29, 2008
INVENTOR(S) : Lee It is certified that error appears in the above-identified patent and that said Letters Patent is hereby corrected as shown below:

Column 8, Lines 60-61, Claim 18, "material into; a surface treatment composition according to claim 2." should read:
-- material into a surface treatment composition according to claim 10. --

Signed and Sealed this

Sixth Day of January, 2009

JON W. DUDAS
*Director of the United States Patent and Trademark Office*